US006185809B1

(12) United States Patent
Pavlovic

(10) Patent No.: US 6,185,809 B1
(45) Date of Patent: Feb. 13, 2001

(54) METHOD OF MANUFACTURING A DIAPHRAGM FOR AN ELECTROACOUSTIC TRANSDUCER

(75) Inventor: Gino Pavlovic, Vienna (AT)

(73) Assignee: AKG Acoustics GmbH, Vienna (AT)

( * ) Notice: Under 35 U.S.C. 154(b), the term of this patent shall be extended for 0 days.

(21) Appl. No.: 08/878,919

(22) Filed: Jun. 19, 1997

(30) Foreign Application Priority Data

Jun. 19, 1996 (AT) ..... 1085-96

(51) Int. Cl.[7] ..... H04R 31/00

(52) U.S. Cl. ..... 29/594; 29/609.1; 367/174; 381/398

(58) Field of Search ..... 29/594, 609.1; 381/150, 151, 191, 39, 432, 174; 367/174; 181/167

(56) References Cited

U.S. PATENT DOCUMENTS

| | | | | |
|---|---|---|---|---|
| 3,586,792 | * | 6/1971 | Gayford | 179/115.5 VC |
| 3,614,335 | * | 10/1971 | Edgware et al. | 179/115.5 R |
| 4,132,872 | * | 1/1979 | Inoue | 179/115.5 R |
| 4,360,711 | * | 11/1982 | Stener | 179/115 R |
| 5,014,322 | * | 5/1991 | Yasuda et al. | 381/174 |
| 5,521,886 | * | 5/1996 | Hirosawa et al. | 367/174 |

FOREIGN PATENT DOCUMENTS

| | | | | |
|---|---|---|---|---|
| 3838853 | | 11/1989 | (DE) . | |
| 4329637 | | 3/1995 | (DE) . | |
| 0137624 | | 4/1985 | (EP) . | |
| 0204386 | | 12/1986 | (EP) . | |
| 0446515 | | 9/1991 | (EP) . | |
| 55-5168 | * | 6/1978 | (JP) | 29/594 |
| 56-141697 | * | 4/1980 | (JP) | 29/594 |
| 58-157293 | * | 3/1982 | (JP) | 29/594 |
| 58-157294 | * | 3/1982 | (JP) | 29/594 |
| 59-27697 | * | 8/1982 | (JP) | 29/594 |
| 59-190799 | * | 4/1983 | (JP) | 29/594 |

* cited by examiner

*Primary Examiner*—Carl J. Arbes
*Assistant Examiner*—Minh Trinh
(74) *Attorney, Agent, or Firm*—Friedrich Kueffner

(57) ABSTRACT

A method of manufacturing a diaphragm for an electroacoustic transducer which operates in accordance with the electrodynamic principle and has portions with different thicknesses made from a thermoplastically deformable material having a constant thickness, wherein, in a first work step, that portion of the diaphragm material which is to have the greater thickness in the finished diaphragm, is held by an inner positioning device, while the remaining area of the diaphragm is additionally held by an outer positioning device, and the remaining area of the diaphragm is pulled or stretched with the influence of tension and heat to reduce the thickness thereof. In a second workstep, the entire diaphragm is thermoplastically stamped in a mold.

4 Claims, 2 Drawing Sheets

METHOD OF MANUFACTURING A DIAPHRAGM FOR AN ELECTROACOUSTIC TRANSDUCER

BACKGROUND OF THE INVENTION

1. Field of the Invention

The present invention relates to a method of manufacturing a diaphragm for an electroacoustic transducer which operates in accordance with the electrodynamic principle and has portions with different thicknesses made from a thermoplastically deformable material having a constant thickness.

2. Description of the Related Art

The behavior of the diaphragm is of particular importance for the manner of operation of each electroacoustic transducer because the behavior determines to a very significant extent the transmission properties of the transducer. In addition to the material properties, the behavior of the diaphragm depends very significantly on the shape of the diaphragm. In electroacoustic transducers which operate in accordance with the electrodynamic principle, a diaphragm shape has been found generally very useful as it is schematically illustrated in FIG. 1 of the drawing.

The center of the diaphragm is dome-shaped and is surrounded by a toroidally-shaped part to which is connected, in turn, a rim for fastening the diaphragm to the magnetic system. The moving coil which moves in a radially extending magnetic field is mounted underneath the dome.

The object of all structural measures is to achieve a piston-like movement of the moving coil at all frequencies and amplitudes. For this purpose, it is necessary to construct the individual diaphragm portions differently in accordance with their function.

Thus, the central dome should be of a construction which is as stiff as possible in order to suppress even at high frequencies the creation of vibration modes which would otherwise lead to drops in the frequency pattern.

The toroidally-shaped portion determines the resiliency and is frequently provided with indentations, or so-called crimpings, which extend tangentially relative to the inner diameter. For this reason, this portion is generally referred to by the term "crimped zone". The softer this crimped zone, the better the sensitivity in the low frequency transmission range will be.

These different requirements with respect to the various portions of a diaphragm of an electroacoustic transducer can be met in an optimum manner if each portion is constructed differently.

However, when manufacturing a diaphragm, these different requirements are frequently not taken into consideration. Thus, the diaphragm material, which usually is present in the form of a foil, is pressed in a stamping mold while pressure and heat are applied. After a cooling phase, the foil is removed and subsequently the final diaphragm is punched out. Except for their different shapes, this method of manufacturing type does not make a difference between the dome-shaped zone and the crimped zone.

Therefore, methods were frequently proposed which provide a stiffening of the dome-shaped zone. For example, by applying a second layer, a stiffening of the dome-shaped zone can be achieved. Thus, EP 0 446 515 A2 even proposes to provide the concave side of the dome with a metal fabric.

Another possibility of achieving a stiff dome area is to construct the diaphragm with different thicknesses. For example, in the construction of loudspeakers, diaphragms are used which have partial areas with different thicknesses. DE 38 38 853 C1 discloses a special thickness distribution of the central portion and the conical portion in order to ensure favorable transmission properties.

It is also possible to divide the diaphragm and to manufacture the central portion of a thicker material, as disclosed in EP 0 204 386 A1.

Another possibility of increasing the stiffness of the central dome-shaped portion is to provide this portion with a special shape, for example, by a central indentation, as shown in FIG. 1 of EP 0 137 624 A2. DE 43 29 637 A1 describes the formation of ribs. The central dome-shaped portion is initially manufactured larger than desired and is subsequently provided in a second deformation process with randomly produced stiffening ribs.

The methods described above are time-consuming and, thus, expensive.

SUMMARY OF THE INVENTION

Therefore, it is the primary object of the present invention to avoid the disadvantages discussed above and to provide a simple and precisely definable manufacturing method for diaphragms having portions with different thicknesses, which method can be used advantageously for electrodynamic transducers.

In accordance with the present invention, a diaphragm of the above-described type with portions having different thicknesses is manufactured in a multistage thermoplastic stamping process from a material having a constant thickness. In a first work step, that portion of the diaphragm material which is to have the greater thickness in the finished diaphragm, is held by an inner positioning device, while the remaining area of the diaphragm is additionally held by an outer positioning device, and the remaining area of the diaphragm is pulled or stretched with the influence of tension and heat to reduce the thickness thereof. In a second workstep, the entire diaphragm is thermoplastically stamped in a mold.

In accordance with another feature of the present invention, the dome-shaped portion of the diaphragm is stamped from the portion of the diaphragm material held by the inner positioning device and the remaining stretched area of the diaphragm material is stamped to form the crimped zone.

Finally, in accordance with another advantageous feature, all manufacturing steps are carried out in a single tool.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
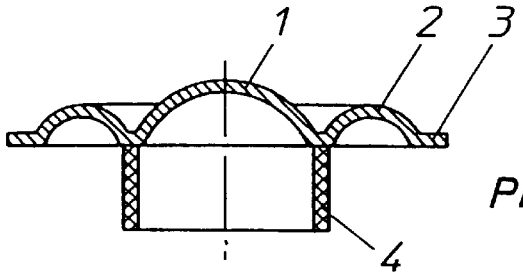
Fig.1 PRIOR ART
FIG. 1 is a cross-sectional view of a complete diaphragm with moving coil for an electrodynamic transducer.

FIG. 1 is a sectional view of a complete diaphragm with moving coil for an electrodynamic transducer. The central dome-shaped portion 1 is surrounded by a toroidally-shaped portion 2. The outer diaphragm rim 3 is used for fastening the diaphragm to the magnetic system, not shown. The moving coil 4 is glued to the diaphragm. The diameter of the moving coil 4 corresponds approximately to the outer diameter of the central dome-shaped portion 1.

Referring to the figures of the drawing and the details shown in the drawing, the manufacturing method according to the present invention will now be described in detail.

Figure 2:
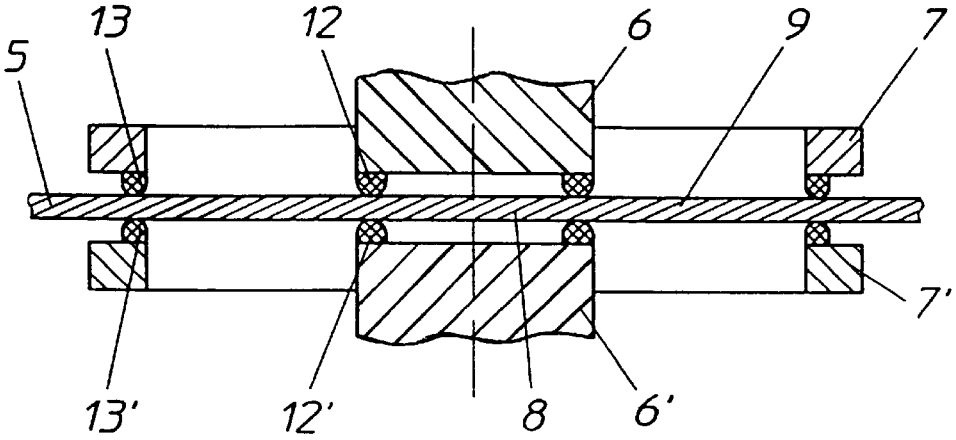
FIG. 2 is a schematic sectional view, on a larger scale, showing the inner and outer positioning devices with the diaphragm material held by the positioning devices.

The diaphragm material 5, usually present in the form of a foil, is initially placed in a first device shown schematically in FIG. 2, which is composed of an inner positioning device 6, 6' and an outer positioning device 7, 7'. The inner positioning device 6, 6' holds that central portion 8 which is to have the greater thickness in the finished diaphragm. In the diaphragm of an electrodynamic transducer, this area will be circular and form the dome-shaped portion 1. The outer positioning device 7, 7' holds an area which corresponds approximately to twice the diameter of the finished diaphragm.

The positioning devices are each composed of two jaws 6, 6' and 7, 7', respectively, arranged above and below the diaphragm material 5. The two jaws 6, 6' and 7, 7', respectively, are pressed together tightly to such an extent that the diaphragm material 5 located therebetween is immovably secured. In order to prevent the diaphragm material from being damaged during holding, the two jaws can additionally be provided with elastic sealing elements 12, 12' and 13, 13', respectively.

Figure 3:
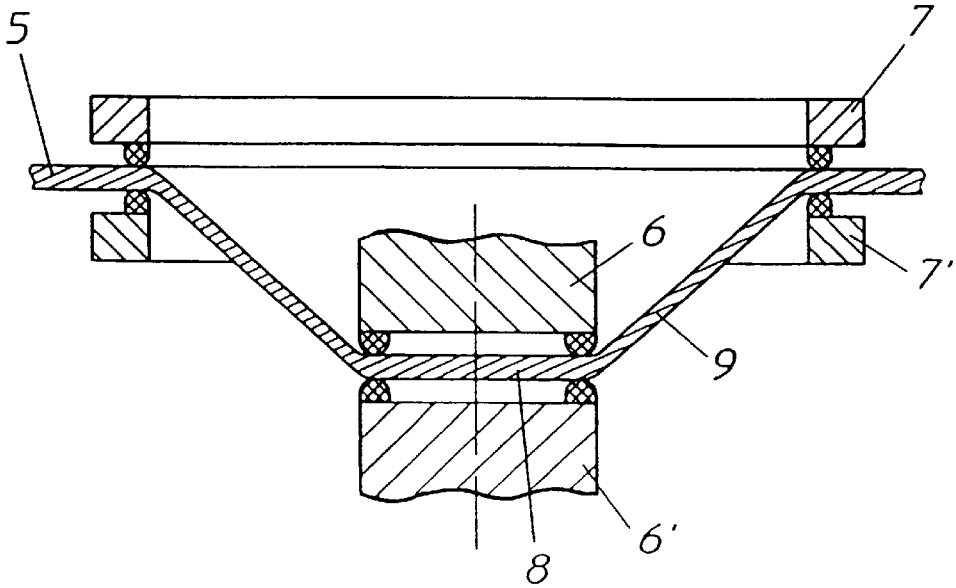
FIG. 3 is a cross-sectional view similar to FIG. 2, showing an extension of the diaphragm material produced by a relative movement between the inner and outer positioning devices.

As schematically illustrated in FIG. 3, the thickness of the annular portion 9 between the inner positioning device 6, 6' and the outer positioning device 7, 7' can be reduced by carrying out a relative movement between the inner positioning device 6, 6' and the outer positioning device 7, 7' and by applying heat.

The greater the relative movement between the inner positioning device 6, 6' and the outer positioning device 7, 7', the greater the reduction of the material thickness will be. Consequently, by suitably selecting the parameters of movement, a suitable means is available for producing a desired thickness of the annular portion 9.

The heat necessary for stretching the diaphragm material 5 can be supplied by applying air or radiation. In the first case, the diaphragm material 5 is directly heated with hot air; in the second case, the surrounding components, i.e., the massive parts of the positioning devices, are electrically heated and these parts, in turn, radiate heat to the diaphragm material 5.

It is advantageous if the supply of heat is carried out in such a way that preferably those portions of the diaphragm material are heated whose thickness is to be reduced. However, it is also conceivable to use a diaphragm material 5 which can be stretched in the cold state. In that case, heating can be entirely omitted.

Figure 4:
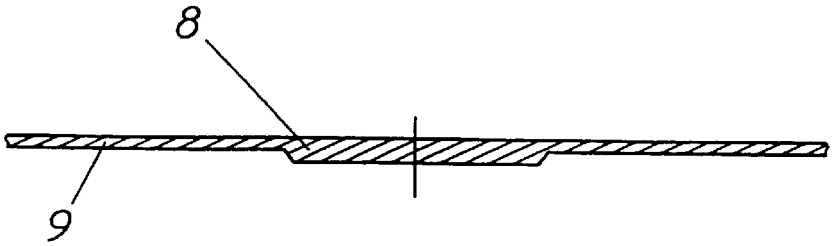
FIG. 4 is cross-sectional view showing the stretched diaphragm material and the significantly thicker middle portion thereof.

FIG. 4 of the drawing shows the result of the first work step, i.e., a diaphragm foil which in its central portion 8 is thicker than in its rim portion 9.

Figure 5:
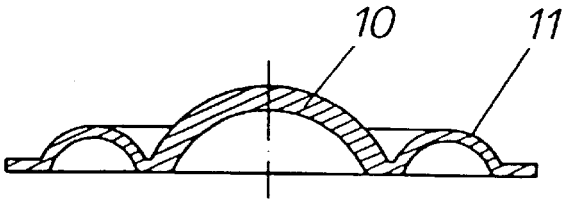
FIG. 5 is cross-sectional view showing the finished diaphragm of an electrodynamic transducer.

Subsequently, in a second work step, this foil is now stamped and punched out by means of a conventional diaphragm mold. FIG. 5 shows a finished punched-out diaphragm whose dome 10 has a significantly greater thickness than the crimped zone 11. It was possible in this manner to realize thickness differences between dome and crimped zone of about 50%.

The manufacturing method according to the present invention is particularly effective when both work steps are carried out in a single tool. The outer and inner positioning devices and the final stamping mold can be combined and arranged so as to be axially moveable relative to each other, so that the manufacturing method according to the invention can take place automatically by means of a suitable control device.

Consequently, the present invention makes it possible to manufacture a diaphragm with different thickness portions with practically the same effort as is required for manufacturing a conventional diaphragm. This makes it possible to inexpensively manufacture diaphragms for electroacoustic transduces which have a thick dome-shaped zone and a thinner crimped zone which significantly improves the vibration behavior of the diaphragm.

While specific embodiments of the invention have been shown and described in detail to illustrate the inventive principles, it will be understood that the invention may be embodied otherwise without departing from such principles.

I claim:

1. A method for manufacturing a diaphragm for an electroacoustic transducer operating in accordance with the electrodynamic principle, the diaphragm having portions with different thicknesses and being manufactured from a foil of thermoplastically deformable material having a constant thickness, the method comprising, in a first work step, placing the foil of the thermoplastically deformable material into a device with an inner positioning device and an outer positioning device and holding by using the inner positioning device that portion of the foil which is to have a greater thickness in the finished diaphragm, while holding an outer portion of the foil additionally by using the outer positioning device, and stretching a remaining material portion of the foil between the inner and outer positioning devices in order to reduce the thickness of the remaining material portion of the foil, and, in a second work step, thermoplastically stamping the foil to a desired shape of the diaphragm in a mold.

2. The method according to claim 1, comprising applying heat to the foil during stretching of the remaining material portion of the foil.

3. The method according to claim 1, comprising forming a dome-shaped portion of the diaphragm from the foil held by the inner positioning device and stamping a crimped zone of the diaphragm from the remaining stretched portion of the foil.

4. The method according to claim 1, comprising carrying out the first and second work steps in a single tool.

* * * * *